United States Patent [19]

Faulconer

[11] Patent Number: 4,860,680

[45] Date of Patent: Aug. 29, 1989

[54] SAILBOAT WITH LEEWAY REDUCING KEEL

[76] Inventor: H. A. Faulconer, 10405 Sierra Vista Dr., LaMesa, Calif. 92041

[21] Appl. No.: 109,915

[22] Filed: Oct. 19, 1987

[51] Int. Cl.[4] ..... B63B 30/38

[52] U.S. Cl. ..... 114/140; 114/39.1

[58] Field of Search ..... 114/140, 39.1, 142, 114/127; 244/219, 219 A

[56] References Cited

U.S. PATENT DOCUMENTS

| | | | |
|---|---|---|---|
| 1,755,886 | 4/1930 | McKenzie | 244/219 |
| 2,918,978 | 12/1959 | Fanti | 244/219 A |
| 3,753,415 | 8/1973 | Burtis | 114/140 |
| 4,074,646 | 2/1978 | Dorfman et al. | 114/140 |
| 4,280,433 | 7/1981 | Haddock | 114/140 |
| 4,538,539 | 9/1985 | Martin | 114/140 |

FOREIGN PATENT DOCUMENTS

| | | | |
|---|---|---|---|
| 2548082 | 5/1977 | Fed. Rep. of Germany | 114/140 |
| 2473005 | 7/1981 | France | 114/140 |
| 2587675 | 3/1987 | France | 114/140 |
| 58-20591 | 7/1981 | Japan . | |
| 97785 | 6/1921 | Switzerland . | |

*Primary Examiner*—Joseph F. Peters, Jr.
*Assistant Examiner*—Edwin L. Swinehart
*Attorney, Agent, or Firm*—Gregory O. Garmong

[57] ABSTRACT

A sailboat includes a fixed keel whose lateral profile is adjustable to create lift that counteracts the leeward drift of the boat when sailing upwind. The keel structure supports side panels that are selectively deflected outwardly to form an airfoil. Deflection of the panels is accomplished by the inflation of bladders positioned between the fixed structure and the inner surface of the panels. As the bladders inflate, the forward and aft ends of the panels pivot on hinge supports to the fixed structure, and the length of the panels increases to accommodate the deflection. With the panel on one side of the keel displaced, the keel becomes a lifting body that generates a force acting to force the sailboat in the upwind direction, thereby counteracting the leeward drift caused by the wind acting on the sails.

18 Claims, 5 Drawing Sheets

SAILBOAT WITH LEEWAY REDUCING KEEL

BACKGROUND OF THE INVENTION

This invention relates to sailboats, and, more particularly, to the keels used thereon.

A sailboat includes a hull that sits in the water, a mast extending upwardly from the hull, sails supported by the mast, and either a centerboard or fixed keel extending downwardly from the hull into the water. The sails catch the wind and cause the hull to move forwardly through the water. A sailboat cannot sail directly into the wind, but can sail in a generally windward direction. With skill and a combination of maneuvers, the sailor can move a sailboat in any desired direction.

Because of the design of the sails, a sailboat can sail to windward, in a direction no less than about 15 to 25 degrees from the wind, depending upon the design of the boat and the skill of the sailor. Headway directly upwind is achieved in a series of sequential maneuvers called tacks, in which the boat is first sailed windward with the wind over one side of the bow, and then turned through the wind so that the wind comes over the other side of the bow. In each tack, some headway upwind is achieved even though the boat does not move directly into the wind, and eventually the sailboat reaches an upwind objective after sailing a zig-zag course covering a distance greater than the straight line distance from the initial position to the upwind objective.

When a sailboat sails to windward, the forces on the sails can be resolved into a thrust component that moves the sailboat forwardly through the water and a drift component that pushes the sailboat sideways in a downwind direction. The sailboat therefore moves in a net direction that is forward, but also is slight downwind opposite to the net intended direction of movement. The sideways drift is called leeway.

The downwardly projecting centerboard or keel of the boat offers resistance to the leeway produced by the sideways sail force, but at least some leeway remains. This leeway is being constantly accumulated, as there is a downwind movement as long as the sailboat is being sailed into the wind. The leeway significantly increases the time required for the sailboat to sail from its downwind starting position to the upwind objective, as it forces the sailboat to sail much further to make up for the accumulated sideways movement.

There have been numerous attempts to reduce the amount of leeway. As previously mentioned, a movable centerboard or fixed keel extending into the water below the sailboat presents a broad surface to resist sideways drift. There have also been attempts to modify the shape of the centerboard or keel to provide a lifting force to counteract the sideways drift. These attempts have been based upon the observation that the centerboard or keel moving through the water is somewhat similar to the wing of an airplane that creates a lift as the wing is moved through the air. This lift of an airplane wing causes the airplane to move upward against the force of gravity, and the corresponding lift of a sailboat centerboard or keel that extends downwardly can cause the sailboat to be lifted in the upwind direction, thereby countering the sideways drift producing the leeway. The use of such a centerboard or keel requires that it be adjustable during operation, as on the average, left or port lift is required half the time when the boat is sailed to windward, and on the average right or starboard lift is required half the time. The use of an underwater wing, which has recently become popular for racing sailboats, has an entirely different purpose, although it operates by a similar principle, for the lift of such a wing is largely upwardly (rather than laterally, as for a leeway reducing keel) to reduce the wetted area of the hull and thence its drag as it moves forwardly.

In one approach, a lifting centerboard is formed by bending a flexible centerboard so as to be shaped like an airplane wing. In another approach, a lifting centerboard assembly is formed by providing two movable centerboards, each having an oppositely disposed airfoil shape. The appropriate centerboard is lowered into the water to obtain lift in one direction, and is withdrawn and replaced with the other centerboard to obtain lift in the other direction. The creation of the proper lift is relatively easily attained with the smaller sailboats that use movable centerboards, as the centerboards can be readily adjusted to achieve either port or starboard lift in varying degrees as needed.

Application of the principles of lifting bodies to fixed keels is conceptually similar, but is technically much more complex and difficult, for several reasons. Fixed keels are typically used in larger sailboats. The keels are usually filled with lead or other dense material to act as ballast for the sailboat. For example, the keels of 12-meter sailboats may extend 10 feet below the surface of the water, and weigh 40,000 to 50,000 pounds, The keels cannot be readily warped or lifted partially out of the water, as can movable centerboards, due to their size and weight. The fixed keels are structurally strong, and thence resistant to deflection. The fixed keels must also remain in the water during the entire course of use, and therefore must be resistant to fouling by marine organisms and seaweed.

There have been proposed approaches to using fixed keels as selectively adjustable lifting bodies. Such approaches have involved complex mechanical systems of arms and levers that extend downwardly from the hull into the keel. The mechanisms are used to selectively deflect the sides of the keel outwardly and inwardly as needed, so that the upwind side of the keel can be bowed to produce a lifting body.

Such mechanical systems are not generally practical for either racing or crusing sailboats. The complex mechanisms are prone to failure, particularly when in contact with corrosive seawater, and failure of any portion of the mechanism results in the keel shape being frozen in its position when the failure occurred. If the failure occurred when the keel was shaped to produce sideways lift, that position is retained until the mechanism is repaired. For a sailboat engaged in a race at the time of failure, the adverse effect of the retained shape on the opposite tack is almost certain to make the sailboat completely noncompetitive. Thus, failure of any part of the mechanism can cause the sailboat to lose the race. Since the most failure-prone components of the mechanism are inside the keel and not accessible during the race, the use of such prior mechanisms is highly risky. The mechanisms are also heavy, and adversely shift the center of gravity of the sailboat.

Accordingly, existing designs for lifting fixed keels have not been widely accepted, and no types of racing or pleasure sailboats are known to use such designs. However, the advantages of using adjustable lifting keels are significant, and development of a technically acceptable lifting keel would undoubtedly result in its widespread use. There therefore exists a need for such a fixed keel which is capable of providing a lifting force to counteract leeway, and is sufficiently reliable to be acceptable for general and racing use. The present invention fulfills this need, and further provides related advantages.

SUMMARY OF THE INVENTION

The present invention provides a sailboat having a fixed keel in the form of a stabilization structure that is selectively and asymmetrically adjustable so as to provide a lifting force to counter leeway as the sailboat sails to windward. The stabilization structure incorporates an adjustability system that is not complex in construction, is reliable, and does not significantly change the center-of-gravity of the sailboat when in place and when in use. The adjustability system also is resistant to corrosion failure and fouling. Failure of the adjustability system, even when in use, results in the adjustable portions of the keel returning to their initial, unadjusted positions. A failure of the mechanism during a race therefore does not effectively remove the boat from competition, but simply makes the advantageous lifting forces unavailable.

In accordance with the invention, a sailboat comprises a hull having a mast extending in an upward direction from the hull, and sails, and a stabilization structure extending in a downward direction from the hull, the structure including panel means for forming the sides of the stabilization structure, the panel means including a deformable panel on each side of the structure, each of the panels being individually deflectable under a deflection force to alter the shape of the structure to form in cross section a lifting body, structural support means for supporting the panel means, the structural support means including reaction surface means for reacting against the deflection force, and means for controllably and selectively applying the deflection force to each of the panels without the use of a mechanical linkage within the structure, the degree of deflection of each panel being independent of the degree of deflection of the other panel, the means for applying acting to return to both panels to a neutral, undeformed position upon failure.

The means for applying the deflection force is preferably at least one pair of inflatable bladders, one of the bladders between each of the panels and the reaction surface. The bladders can be selectively inflated with any acceptable gas or liquid, such as compressed air produced by pumps on the boat, bottled compressed gas, or water pumped into the bladders with pumps. There are no mechanical linkages or other movable devices extending from the hull into the keel, that are subject to failure. Only gas or hydraulic lines reach into the keel, with all mechanical valving in the hull.

In the unlikely event of a valve failure, the valve can be readily replaced during a race. Additionally, failure of any component of the system merely deflates the bladders, so that the movable side panels return to their undeflected positions. Because the port and starboard bladder systems are independent of each other, the side plate on the side where the failure has occurred cannot be used until repair is effected, but the side plate on the other side of the keel can be used in the normal fashion to achieve upwind lift. The system is therefore partially usable even when certain components have failed, and repair of most components that can fail is readily accomplished because the components are in the hull or on deck. The use of multiple bladders on each side and redundancy in the inflation system further reduces the chances that there could be a complete loss of effectiveness of the system in the event of a component failure. Because the valves, tubing, and bladders are relatively lightweight in comparison to mechanical systems, a partially or totally failsafe system is feasible.

The structural support means preferably includes two or more heavy beams extending downwardly from the hull, at the traditional location of the keel, and supported from the hull and internal bulkheads and stiffeners. The lead ballast is supported by and attached to the lower end of the beams, in a streamlined container or within wings that can extend outwardly from the bottom end of the keel. The reaction surface is disposed between and supported by the support beams, and typically runs between the beams. There may be a single reaction surface running down the centerline of the boat, or there can be two reaction surfaces, one attached to the port sides of the support beams and one attached to the starboard sides of the support beams. The bladders are disposed between the reaction surface or surfaces and the side panels, so that selective inflation of the respective bladders push the corresponding panels outwardly to form the curved portion of the lifting surface.

As the panels are pushed outwardly, their shape changes, and there must be provision for accommodating the change in length. Preferably, there is provided a forward hinge extending downwardly from the hull at a position forward of, and supported by, the forward support beam. The two side panels are hingedly supported by the forward hinge, so that each panel can independently rotate outwardly as it is displaced outwardly by inflation of the bladder, and rotate inwardly as the bladder is later deflated.

Similarly, an aft hinge extends downwardly from the hull at a position aft of, and supported by, the aft support beam. The two side panels are hingedly supported by the aft hinge, so that each panel can independently rotate outwardly as it is displaced outwardly by inflation of the bladder, and rotate inwardly as the bladder is later deflated. In the case of both the forward and aft hinges, the rotation is no more than a few degrees for full bladder inflation.

As each panel is deflected outwardly, with its ends fixed, it must lengthen, and must shorten as is relaxed inwardly. Each panel is therefore provided with an extensible joint therein, which permits the panel to automatically lengthen or shorten as necessary.

The upper end and the lower end of the support structure preferably include an upper and lower housing, respectively. The housing defines the upper and lower ends of the support structure and aids in maintaining its rigidity. The underside of the upper housing and the upper side of the lower housing include recessed portions whose sidewalls define the maximum extent of the desired deflection of the respective side panels on each side of the boat. The side panels fit within, and in a sense are captured within, the recesses in the top and bottom housings. When the bladders are inflated, the side panels are pushed outwardly to contact the sides of the recesses, but the extent of the deflection is limited by the shape of the sidewalls of the recesses. The side panels tend to assume the deflection curvature defined by the sidewalls of the recesses, so that the shapes of the side panels at maximum deflection can be readily controlled. Although in some instances it may be desirable to deflect the side panels to a lesser degree of deflection than permitted by the side walls of the recesses, in normal operation the full deflection is utilized. Even where only partial deflection is used, the forward and aft constraints of the hinges, and the method of construction of the side panels, to be described later, provide a generally aerodynamic lifting body shape to the deflected panel.

As discussed previously, the present approach is fully consistent with the use of underwater wings that extend outwardly from the sides of the keel near its lower extremity. The wings give upward lift, and also act to improve the aerodynamics of the keel by preventing vortices from spinning off the downward end of the support structure. In some instances, the lifting effect of the wings is not needed, but the vortex control is desired. In such situations, the wings may be omitted and replaced by an end plate that extends outwardly from either side of the bottom of the keel structure. The end plate is not a structural element, and can be made thin so as to provide a low drag. In this case, the ballast is normally carried at or near the lower end of the support structure within the structure or in a streamlined pod.

Thus, in accordance with a preferred embodiment of the invention, a sailboat comprises a hull having a mast extending in an upward direction from said hull, and sails, and a stabilization structure extending in a downward direction from the hull, said structure including a support structure, including a forward support beam and an aft support beam extending downwardly, a reaction web between the forward beam support and the aft support beam, a downwardly extending forward hinge forward of, and supported by, the forward support beam, and a downwardly extending aft hinge rearward of, and supported by, the aft support beam, a pair of side panels, one on each side of the support structure, the forward end of each panel hingedly joined to the support structure by said forward hinge, and the aft end of each panel hingedly joined to the support structure by the aft hinge, each of the side panels having an extensible joint therein, whereby the length of the panel parallel to the waterline changes upon displacement of said panel, and at least one pair of bladders, one of each pair of bladders on each side of the support structure, each bladder being disposed between the reaction web and the respective panel, each of the bladders being inflatable to displace its respective panel outwardly and being deflatable to permit its respective panel to relax inwardly, the displacement of each panel being controllable independently of the displacement of the other of the panels.

It will now be appreciated that the present invention provides a sailboat having an adjustable structure for stabilizing the sailboat against leeway drift, and for creating a lift that counteracts the leeway and permits the sailboat to sail an upwind course that is shorter and, in net effect, closer to the wind. The structure is reliable, and does not require mechanical linkages to pass downwardly into the stabilization structure. If the displacement apparatus fails, only partial disablement results. Other features and advantages of the invention will be apparent from the following more detailed description of the preferred embodiment, taken in conjunction with the accompanying drawings, which illustrate, by way of example, the features of the invention.

DETAILED DESCRIPTION OF THE PREFERRED EMBODIMENT

Figure 1:
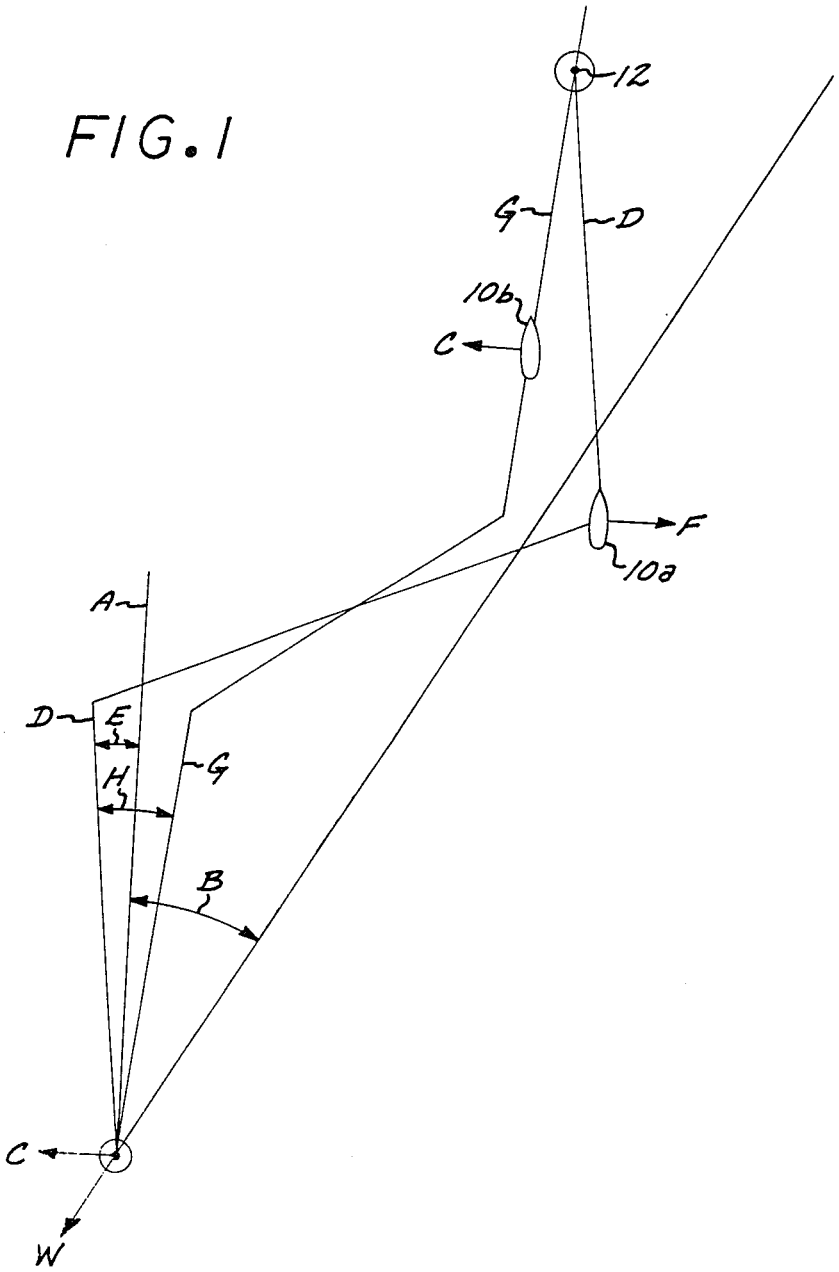
FIG. 1 is a course diagram illustrating the source of leeway, and the effect of providing sideways lift to counteract the leeway.

FIG. 1 illustrates the effect of leeway, and a counteracting keel-induced lift, on the course of a sailboat 10. The sailboat 10 is being sailed upwind to a windward mark 12, in a series of tacks. Each tack is on a course A and B degrees off the direction of the wind W, which is determined to be the optimal course and speed permitted to the sailboat 10. A typically is from about 20 to about 35 degrees, and is illustrated in FIG. 1 to be 30 degrees. The sailboat 10 is steered on the intended course A, but sideways forces on the sail, in a direction indicated by the arrow C, push the sailboat 10 in a downwind direction, away from its intended course toward the mark 12. The result is a downwind drifting of the sailboat below its intended course A, to a new effective leeway course D. The difference between the intended course A and the effective leeway course D is termed the "leeway" E, here illustrated to be about 6 degrees.

A counteracting sideways lifting force F, provided by the lifting keel in the manner described, acts to lift the sailboat 10 toward the wind and toward its intended objective, the mark 12. The course of the sailboat 10 is thereby changed to an effective lifting course G. The difference between the effective leeway course D and the effective lifting course G is termed the "lift" H, here illustrated to be about 12 degrees.

FIG. 1 also illustrates the practical effect of obtaining the lift H. The leeway 10*a* must travel a course to the mark 12 that is longer than the corresponding course sailed by the lifted sailboat 10*b*. In the exemplary illustration of FIG. 1, the distance travelled by the leeway sailboat 10*a* is about 13–14 percent farther than the lifted sailboat 10*b*, to reach the mark 12 in three tacks. The actual difference in distance sailed for any particular case will depend upon the magnitudes of the leeway and the lift, the orientation of the wind and the mark, and possible changes in boat speed, as well as the strategy of the sailors. Typically, however, the advantage due to the lift obtained with the keel of the invention is much larger than the margin of victory in most well-sailed races, which is typically less than 1 percent.

Figure 2:
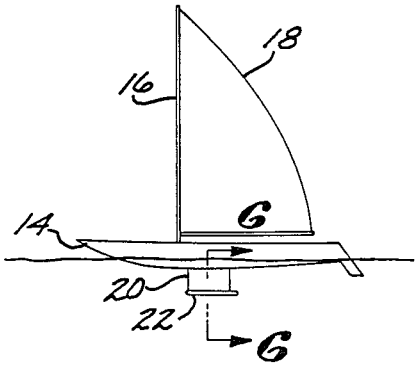
FIG. 2 is a side elevational view of a sailboat with the stabilization structure of the invention.
Figure 3:
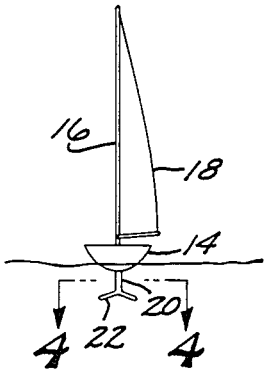
FIG. 3 is a front elevational view of the sailboat of FIG. 2.

The general features of the sailboat 10 are illustrated in FIGS. 2 and 3. The sailboat 10 includes a hull 14 with a mast 16 extending upwardly from the hull 14. Sails 18 are supported by the mast 16, and when driven by the wind, provide the motive power for the sailboat 10. A keel 20 projects downwardly from the bottom of the sailboat 10, and is entirely underwater. In FIGS. 2 and 3, a wing 22 projects outwardly from the sides of the keel 20, in a manner that has become popular for some racing sailboats. This wing 22 is optional, and in many cases is not required when the present invention is used.

Figure 7:
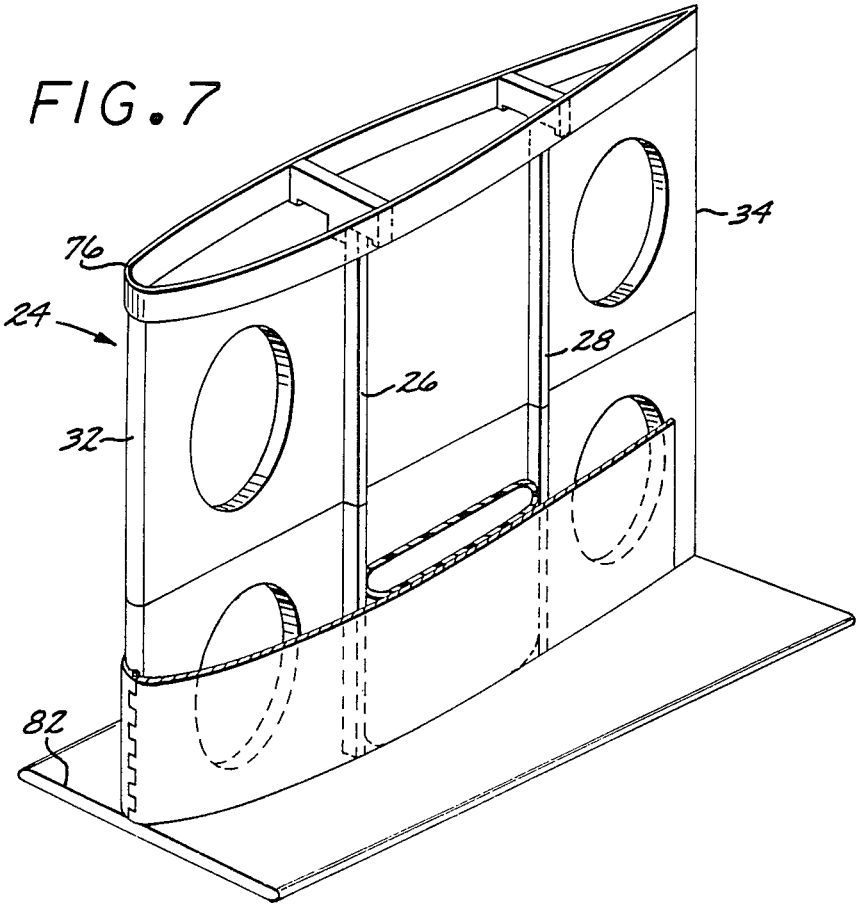
FIG. 7 is a perspective view of the support structure portion of the stabilization structure, using an end plate.
Figure 4:
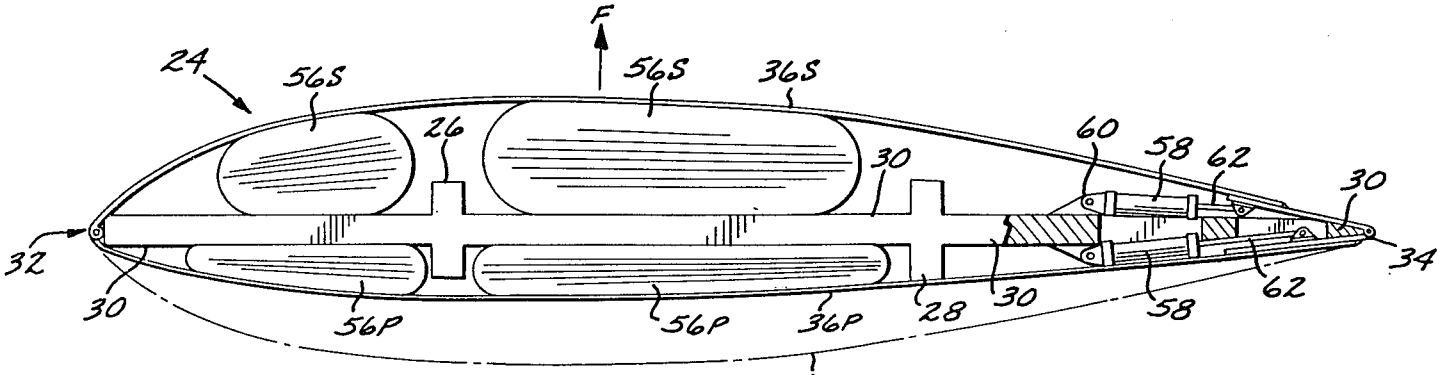
FIG. 4 is a top sectional view of the stabilization structure, taken generally along line 4—4 of FIG. 3.
Figure 6:
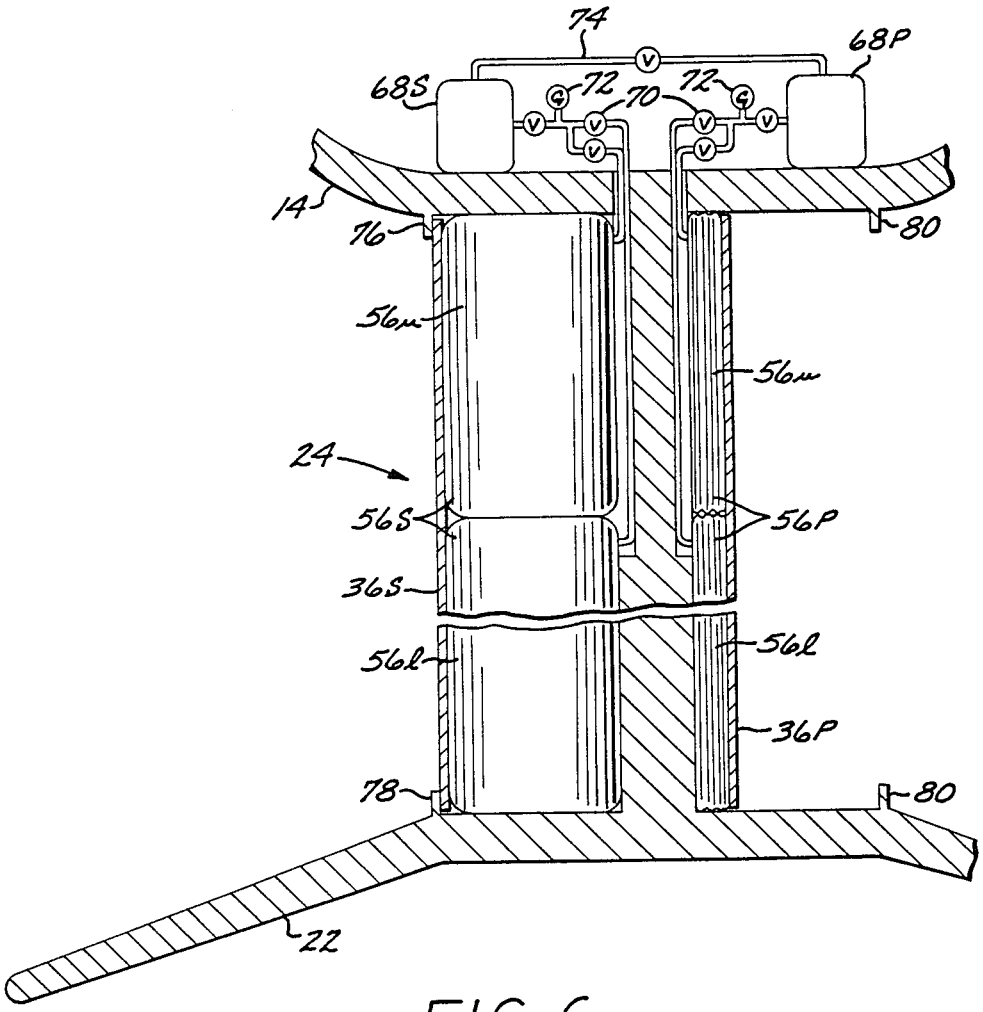
FIG. 6 is a front sectional view of the stabilization structure and lower portion of the hull, taken generally along line 6—6 of FIG. 2.

The keel 20 includes a stabilization structure 24, illustrated in FIGS. 4, 6, and 7. The stabilization structure 24 extends downwardly from the hull 14. It includes a pair of support beams attached to the hull 14, a forward support beam 25 and an aft support beam 28. The support beam 26 and 28 are heavy structural members that are preferably cast integral with the bottom portion of the hull 14, or welded to the separately fabricated hull 14. The support beams 26 and 28 together must be sufficiently strong to support the ballast of the sailboat 10, which is carried at the lower end of the stabilization structure 24.

Figure 5:
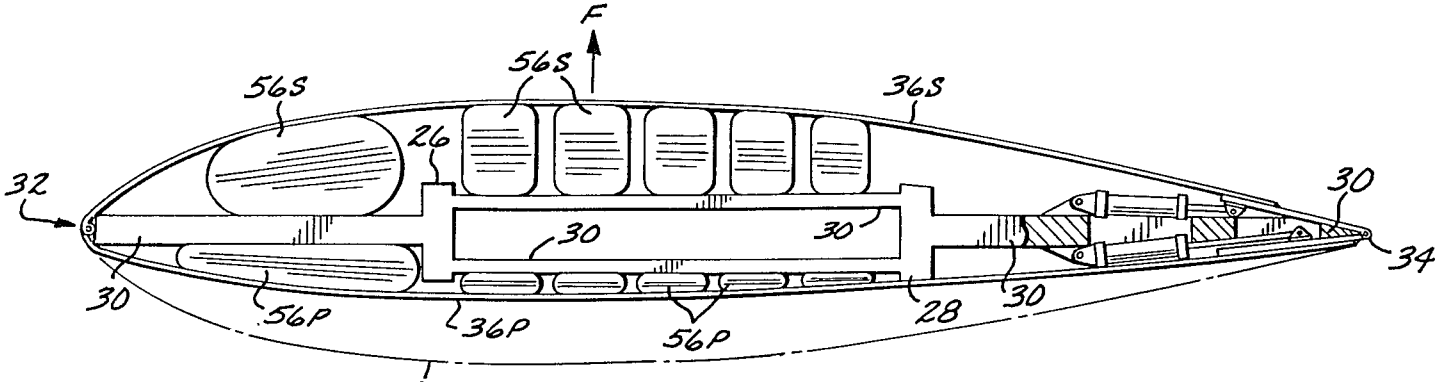
FIG. 5 is a top section view of the stabilization structure similar to FIG. 4, except illustrating alternative embodiments and features.

The two support beams 26 and 28 are connected together with a reaction web 30, which is a structural member that stiffens the framework formed by the beams 26 and 28, and the web 30. The reaction web 30 may be a single plate structure, as illustrated in FIG. 4, or may utilize alternative multiple plate structure, as illustrated in FIG. 5. It may have lightening holes cut therein, as illustrated in FIG. 7.

The reaction web 30 extends forward of the forward support beam 26 and rearward of the aft support beam 28. A forward hinge 32 is fixed in a generally vertical orientation, with the hinge axis vertical and parallel to the beams 26 and 28, to the most forward edge of the support structure formed by the beams 26 and 28, and the web 30.

Two side panels 36 are provided on the stabilization structure 24, one on the left or port side and the other on the right or starboard side. The panels 35 form the lateral sides of the stabilization structure 24, and can be displaced laterally outwardly or relaxed inwardly. Each side panel 36 may be displaced independently of the other side panel.

Figure 8:
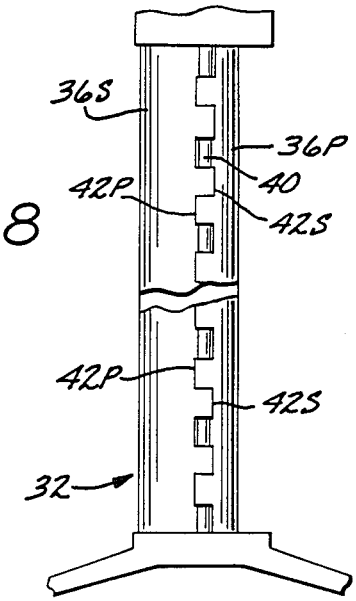
FIG. 8 is a front elevational view of the stabilization structure, illustrating the forward hinge.

The side panels 36 are joined to the forward end of the reaction web 30, through the hinge 32. The aft or rearward ends of the panels 36 are joined at another hinge 34, which in the preferred embodiment is affixed to the web 30. FIG. 8 illustrates the structure of the forward hinge 32, and the structure of the aft hinge 34 is similar. The forward hinge 32 is formed in the manner of a piano hinge, with a hinge axle (not shown) forming the axis of the hinge movement. The hinge axle and the hinge itself are supported by a plurality of web fingers 40 extending forwardly from the forward end of the reaction web 30. The fingers 40 terminate in loops that encircle the hinge axle and support it. The panels 36 are supported on the hinge 32 by similar panel fingers 42 that extend forwardly from the forward end of the panels 36. The left or port side panel **36*p* has a set of panel fingers 42*p* that encircle the hinge axle, and the right or starboard side panel 36*s* has a set of panel fingers 42*s* that encircle the hinge axle. (For certain features of the structure 24, it will be necessary to distinguish between corresponding structure found on the port side p, and the starboard side s. For such features, the appropriate designation s or p will be affixed to the element number in the drawings and specification.) The web fingers 40 and the panel fingers 42*s* and 42*p* alternate in the sequence of contacting the hinge axle, so that every third finger contacting the hinge axle is of the same type, as shown in FIG. 8**. This arrangement provides good stability to the hinge movement.

Figure 9:
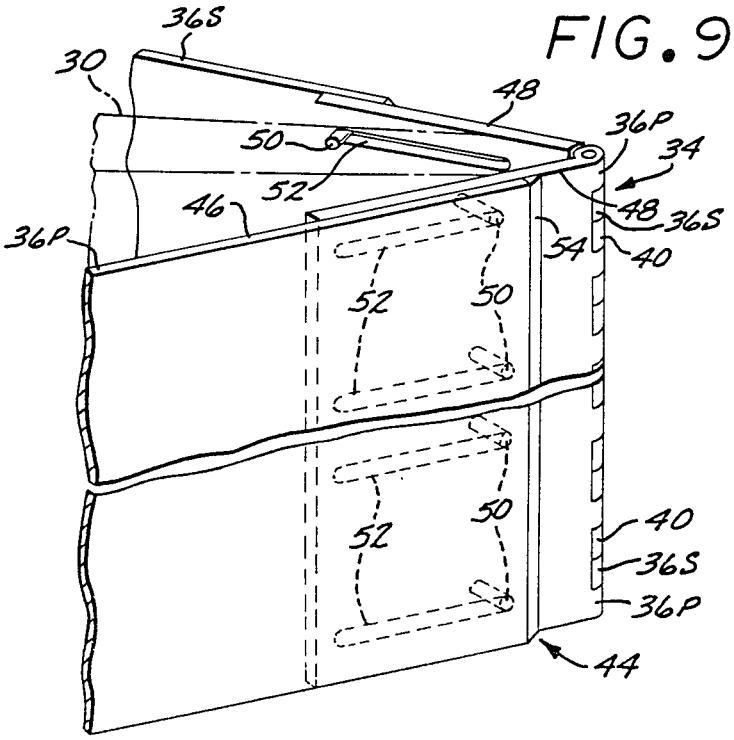
FIG. 9 is a perspective view of the attachment of the side panels to the aft hinge, with portions shown in phantom view, illustrating the extensible portion of the side panels.

As the panel 36 is displaced outwardly, its forward and aft ends pivot on the hinges 32 and 34. To accomplish this displacement, the length of each panel 36 in a forward-aft direction must increase when the panel is displaced outwardly, and decrease when the panel is displaced or relaxed inwardly. An extensible section 44 is therefore provided in each of the panels 36, and the extensible section 44 is illustrated in FIG. 9.

The extensible section 44 is preferably provided in the aft end of the panels 36, to minimize any possible adverse hydrodynamic or drag effects on the performance of the sailboat 10. To form the extensible section 44, each panel has a forward segment 46 and an aft segment 48. The forward segment 46 overlaps the aft segment 48 on the outside. A plurality of extension pins 50 project inwardly from the inside surface of the forward segment 46 near its trailing edge. The extension pins engage extension slots 52 in the aft segment 48, the slots 52 being elongated in the direction from the forward end to the aft end of the panels 36. As the panels 36 are displaced outwardly or inwardly, the pins 50 slide in the slots 52 to permit segments 46 and 48 to move with respect to each other, thereby causing the effective length of the panels 36 to increase or decrease, respectively. A rubber wiper 54 may be provided along the aft edge of the forward segment 46 to partially seal the extensible section 44, and also to minimize the formation of adverse hydrodynamic conditions with increased drag.

At least one pair of inflatable bladders 56 is provided to displace the panels 36 outwardly. The bladders 56 are disposed between the inner surface of the respective side panels 36 and the reaction web 30. When the bladders 56 are inflated, the panel 36 is displaced outwardly, and when the bladders 56 are deflated, the panel 36 relaxes inwardly. The bladders 56 on the port and starboard are selectively and separately inflatable and deflatable, so that the side panels **36*p* and 36*s* can be selectively and separately displaced. To illustrate the aspects of structure with the panels 36 in outwardly displaced and inwardly relaxed positions, the views of FIGS. 4–6 are shown with the port side panel 36*p* in the inwardly relaxed position and the starboard side panel 36*s* in the outwardly displaced position. This arrangement would be used when the sailboat is on starboard tack, with the wind coming over the right side of the bow, as illustrated in the first tack of FIG. 1. The positions of the panels would be selectively reversed, with the port side panel 36*p* displaced outwardly and the starboard side panel 36*s*** relaxed inwardly, when the sailboat is on port tack.

As shown in FIG. 4–6, the panel **36*s* is displaced outwardly with the bladders 56*s* inflated. The panel 36*p* is relaxed inwardly with the bladders 56*p* deflated. At least one pair of bladders, a port bladder 56*p* and a starboard bladder 56*s*, are provided. Preferably, there are multiple pairs of bladders to provide additional control over the shaping of the outer surface of the panels, to provide more sources of the force required to displace the panels 36 outwardly, and to reduce the adverse impact of the failure of a single bladder. In FIG. 4, two pairs of bladders are shown in section. In FIG. 5, the single bladder on each side between the forward support beam 26 and the aft support beam 28 is replaced by five smaller bladders. The bladders can also be separated into upper bladders 56***u* and lower bladders 56*l*, as illustrated in FIG. 6. In general, the use of multiple pairs of bladders is highly preferred, for the reasons mentioned.

Because of the forces required, the use of the bladders 56 may not be sufficient to cause the desired displacements of the panels 36. Accordingly, a pair of jacks 58, one on the port side and one on the starboard side, is provided to assist in the outward displacement and inward relaxation of the panels 36. The bodies 60 of the jacks 58 are rigidly mounted on either side of the reaction web 30, near its aft end. The movable pistons of the jacks 58 are connected to the inner ends of the extension pins 50, or to some other portion of the forward segment 46 of the respective panels 36. To assist in the displacement of the panel 36 outwardly, the jack 58 is operated to draw the pins 50 forwardly at the same time as the bladders 56 are inflated. To assist in the displacement or relaxation of the panel 36 inwardly, the jack 58 is operated to push the pins 50 rearwardly at the same time as the bladders 56 are deflated.

The inflation system 64 for inflating and deflating the bladders 56 is shown in FIG. 6. In general, the port side bladders 56*p* are selectively operated together as one group, and the starboard side bladders 56*s* are selectively operated together as another group. Inflation lines 66 lead upwardly from each bladder 56, through the stabilization structure 24 and into the bottom of the hull 14. The lines 66 are connected to a pressurization supply 68, through a plurality of regulators 70 and with release-type gauges 72, which provide a measurement of the pressure and can be adjusted to release excess pressure above any preset level to avoid overpressurization of the system. Preferably, two independently operable pressurization subsystems are provided within the system 64 for inflation and deflation of the port and starboard bladders 56, to reduce the adverse impact of equipment failure and to provide for ease of control and redundancy.

For example, by providing a redundant pressurization line 74, the effect of failure of either of the supplies 68 can be minimized. If any bladder fails, it can be valved off with the appropriate regulator 70. A failed valve can be readily replaced within the hull. Thus, failure of a component of the present inflation system 64 does not result in loss of the entire system, and most adverse effects can be overcome without removing the system from operation. In the event of a total failure of either the port inflation system 64*p* or the starboard inflation system 64*s*, the respective panel 36*p* or 36*s* returns to its inwardly displaced or relaxed position, with the aid of the jack 58, if necessary. In this position, the panel of the failed system exerts low drag, as this is its intended position for sailing on points other than into the wind. The favorable outward displacement of the panel on the failed part of the system would not be available when the sailboat is sailed upwind, but there would not be adverse consequences. On the other hand, the panel which remains available for use can be used to advantage when the sailboat is being sailed upwind and lift from that panel is favorable. As noted, however, the likelihood of a total failure of either of the systems 64*s* or 64*p* is small, due to the redundant design features discussed.

The degree or extent of deflection of the side panels 36 is controllable by partially or totally inflating the bladders 56. Normally, the side panels 36 are displaced to a full displacement position. In this position, the panels 36 are configured to provide an optimum lifting force, based upon the tailoring of the system to any particular sailboat and sailing conditions.

The full displacement position is defined by an upper housing 76 at the upper end of the stabilization structure 24, and a lower housing 78 at the lower end of the stabilization structure 24. The housings 76 and 78 include sidewalls 80 that are shaped to the optimum full displacement position of the panels 36. As illustrated in FIG. 6, the sidewalls 80 form a recessed portion of the housings 76 and 78, and the panels 36 fit within the recesses. The panels 36 cannot be displaced outwardly further than permitted by the positioning of the sidewalls 80, regardless of the degree of inflation of the bladders 56. The position of the sidewalls 80, from the forward end to the aft end of the stabilization structure 24, thus determines the full displacement shape of the side panels 36. The full displacement shape can therefore be altered by reshaping the sidewalls 80, in combination with any necessary changes to the bladders 56.

In operation, when a lifting force F is desired to counteract leeway E as the sailboat is tacking windwardly, the side panel 36, on the side in which the lift is desired, is displaced outwardly while the other side panel is relaxed inwardly. The keel 20 therefore has an asymmetrical configuration as shown in FIG. 4, in the general shape of an airplane wing. Just as the airplane wing generates lift in the upward direction, the keel 20 also generates lift in the direction F. On the opposite tack, the displacement is reversed. In the illustrated asymmetric configuration, the drag of the keel 20 is greater than when both side panels 36 are fully retracted. When no lift is required, as when the sailboat 10 is sailed downwind, then both side panels 36 are relaxed inwardly to form a shape having minimum drag.

In the embodiment illustrated in FIGS. 3 and 6, there is provided the wing 22 at the bottom end of the keel 20. Alternatively, a plate 82 can be placed at the bottom end of the keel 20, the plate extending outwardly from the sides of the keel, as illustrated in FIG. 7. The plate 82 prevents the formation of drag-inducing vortices at the lower end of the keel 20, improving its performance. Where the wing 22 is provided, it also performs this function of vortex avoidance.

It will be appreciated that the keel of the present invention provides a reliable structure for providing a lifting force to counteract leeway in sailboats. Although a particular embodiment of the invention has been described in detail for purposes of illustration, various modifications may be made without departing from the spirit and scope of the invention. Accordingly, the invention is not to be limited except by the appended claims.

What is claimed is:

1. A sailboat comprising:

a hull having a mast extending in an upward direction from said hull, and sails; and a stabilization structure extending in a downward direction from said hull and having two laterally facing sides, said structure including panel means for forming the outer sides of said stabilization structure, said panel means including a pair of deformable panels, one forming each outwardly facing lateral surface of said structure in direct contact with the water, each of said panels being independently deflectable under a deflection force to alter the shape of said structure to form in cross section a lifting body, structural support means for supporting said panel means, said structural support means including reaction surface means for reacting against the deflection force, and means for controllably and selectively applying the deflection force to each of said panels without the use of a mechanical linkage within said structure, the degree of deflection of each panel being independent of the degree of deflection of the other panel, said means for applying acting to return both panels to a neutral, undeformed position upon failure.

2. The sailboat of claim 1, wherein said means for applying the deflection force includes a pair of inflatable bladder means for applying a deflection force when inflated, said bladder means including at least one bladder member between each of said panels and said reaction surface means.

3. The sailboat of claim 2, wherein said means for applying further includes means for inflating said bladder members with water.

4. The sailboat of claim 2, wherein said means for applying further includes means for inflating said bladder members with air.

5. The sailboat of claim 2, wherein each of said bladder members includes a plurality of bladders.

6. The sailboat of claim 1, wherein said means for applying the deflection force includes a plurality of pairs of bladders, one of each pair on the port side and one of each pair on the starboard side of said sailboat between the respective panel means and the structural support means.

7. The sailboat of claim 1, wherein said structural support means further includes a forward hinge at the end thereof closest to the bow of said sailboat, and the end of each of said panels closest to the bow of said sailboat is hingedly joined to said structural support means, so that the bow end of each of said panels can pivot outwardly as said panel is deflected.

8. The sailboat of claim 1, wherein said structural support means further includes an aft hinge at the end thereof closest to the stern of said sailboat, and the end of each of said panels closest to the stern of said sailboat is hingedly joined to said structural support means, so that the stern end of each of said panels can pivot outwardly as said panel is deflected.

9. The sailboat of claim 1, wherein each of said panels includes an extensible joint therein, whereby said panel can change in the length as it deflects.

10. The sailboat of claim 1, further including a pair of jacks to assist in deforming said panels, one of said jacks attached between the structural support means and each of said panel means.

11. The sailboat of claim 1, wherein said stabilization structure further includes a pair of wings extending outwardly therefrom, one on each side of said stabilization structure, that provide a lifting force.

12. The sailboat of claim 1, wherein said stabilization structure includes a pair of end plates extending outwardly from the bottom end thereof, one on each side of said stabilization structure, to prevent the formation of vortices at the bottom of said stabilization structure.

13. A sailboat, comprising:

a hull having a mast extending in an upward direction from said hull, and sails; and a stabilization structure extending in a downward direction from said hull, said structure including a support structure, including a forward support beam and an aft support beam extending downwardly, a reaction web between said forward beam support and said aft support beam, a downwardly extending forward hinge forward of, and supported by, said forward support beam, and a downwardly extending aft hinge rearward of, and supported by, said aft support beam, a pair of side panels, one on each side of said support structure, the forward end of each panel hingedly joined to said support structure by said forward hinge, and the aft end of each panel hingedly joined to said support structure by said aft hinge, each of said side panels having an extensible joint therein, whereby the length of the panel changes upon displacement of said panel, and at least one pair of bladders, one of each pair of bladders on each side of said support structure, each bladder being disposed between said reaction web and said respective panel, each of said bladders being inflatable to displace its respective panel outwardly and being deflatable to permit its respective panel to relax inwardly, the displacement of each panel being controllable independently of the displacement of the other of said panels.

14. The sailboat of claim 13, wherein said hinge is a piano hinge.

15. The sailboat of claim 13, wherein there are at least two pairs of bladders, each of said bladders being inflatable independently of the other bladders.

16. The sailboat of claim 13, wherein said reaction web includes a pair of web members, one extending between the left side of said forward support beam and the left side of said aft support beam, and the other extending between the right side of said forward beam and the right side of said aft support beam.

17. The sailboat of claim 13, further including a pump to inflate said bladders with water.

18. The sailboat of claim 13, further including a pump to inflate said bladders with air.

* * * * *